United States Patent [19]

Ray

[11] 4,393,618

[45] Jul. 19, 1983

[54] NOVELTY WRITTEN MESSAGE DEVICE SUITABLE FOR MAILING

[76] Inventor: Otis E. Ray, P.O. Box 40302, St. Petersburg, Fla. 33743

[21] Appl. No.: 265,204

[22] Filed: May 19, 1981

[51] Int. Cl.[3] ..... A63H 1/30

[52] U.S. Cl. ..... 46/35; 46/61; 229/92.8

[58] Field of Search ..... 46/61, 63, 62, 47, 49, 46/35

[56] References Cited

U.S. PATENT DOCUMENTS 884,394 4/1908 Keegan ..... 229/92.8 X 2,616,199 11/1952 Robins ..... 46/35 X 3,430,761 3/1969 Pelkey ..... 229/92.8 X

OTHER PUBLICATIONS

Renner, A. G.—Experimental Fun with the Yo-Yo—Dodd Mead & Co., N.Y., ©1979—pp. 26-31, 36 and 37.

*Primary Examiner*—F. Barry Shay

*Attorney, Agent, or Firm*—B. P. Fishburne, Jr.

[57] ABSTRACT

A fully functional spinning toy of the yo-yo type is adapted to serve as an easily mailable written greeting or message medium. The extreme thinness of the device enables standard envelope mailing within postal regulations. The device is also useful for advertising, as a premium, and as a business gift.

2 Claims, 4 Drawing Figures

NOVELTY WRITTEN MESSAGE DEVICE SUITABLE FOR MAILING

BACKGROUND OF THE INVENTION

The objective of this invention is to provide a readily mailable novelty message unit which is very inexpensive and can serve a wide variety of useful purposes, such as a greeting device, advertising premium, or business gift. The device is embodied in a tethered spinning toy of the yo-yo class which is fully functional for amusement purposes. It is flat on both sides and of a sufficient diameter to accept writing and/or advertising indicia on both sides. The device is of extremely thin construction enabling it to be mailable in standard envelopes well within postal regulations as to thickness without encountering a penalty charge.

Other features and advantages of the invention will become apparent during the course of the following description.

DETAILED DESCRIPTION

Figure 3:
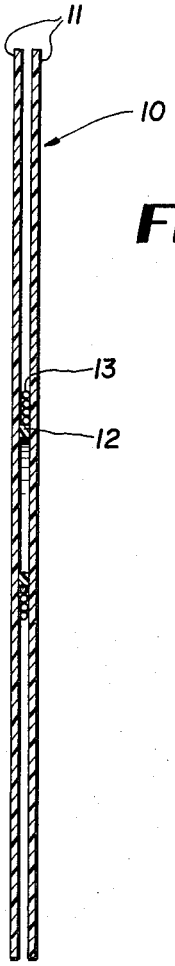
FIG. 3 is an enlarged vertical section taken on line 3—3 of FIG. 1.
Figure 4:
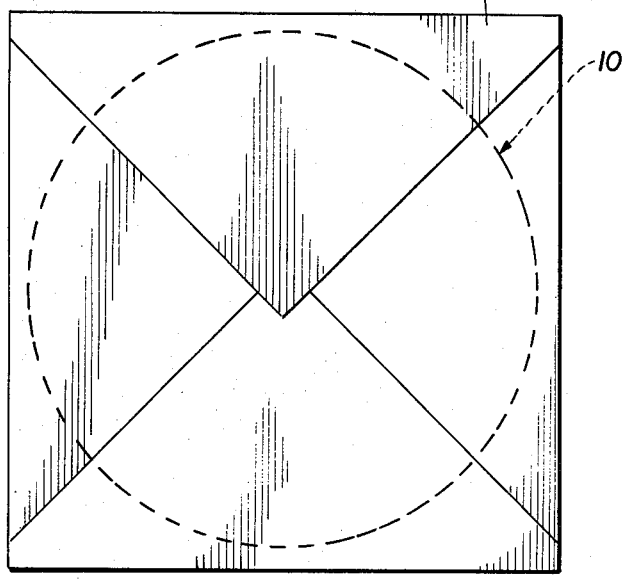
FIG. 4 is a side elevation of a mailing envelope containing the novelty device.

Referring to the drawings in detail wherein like numerals designate like parts, a message bearing unit in the form of a spinning toy commonly known as a yo-yo is indicated by the numeral 10. The device comprises a pair of thin stiff flat discs 11 which may be formed of plastics, stiff paperboard or the like. The two flat discs are secured in side-by-side closely spaced parallel fixed relationship by a centrally located thin spacer ring 12 suitably attached to the discs as with adhesive. The spacer ring forms the axle of the spinning toy to which a suitable length of string 13 is attached to complete the construction of the yo-yo like toy. As shown in FIG. 3, the narrow space between the discs 11 is approximately equal to the thickness of string or tether 13, so that the string may be wound on the spacer ring 12 in overlapping convolutions lying in a common plane between the two discs and substantially filling the space therebetween.

Preferably, the device measures approximately $4\frac{1}{2}$ inches in diameter with an overall thickness of $\frac{1}{8}$ inch or slightly more, the elements 11 and 12 each having a thickness somewhat in excess of 3/32 inch. While these dimensions are not critical, the overall thickness dimension is important to enable mailing of the unit in a standard mailing envelope 14 whose thickness will be well within postal regulations pertaining to envelope thickness which will avoid penalty charges. The assembled device has a weight of only one ounce with the stated dimensions, enabling it to be mailed as a first class one ounce letter.

Figure 1:
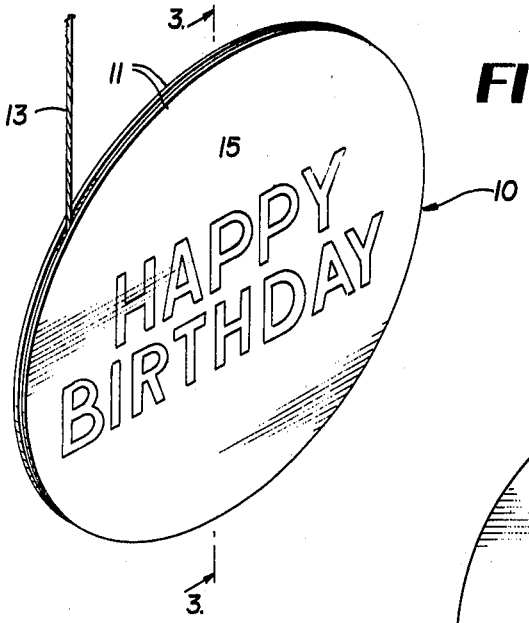
FIG. 1 is a perspective view of a novelty message device according to the invention.
Figure 2:
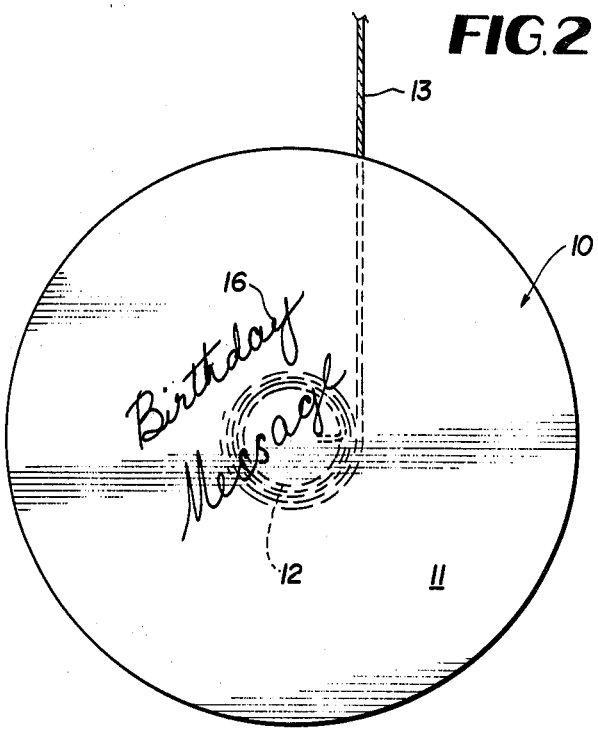
FIG. 2 is a side elevation of the device showing the side opposite to that in FIG. 1.

As described, the unit is fully functional as a yo-yo type toy. On one outer side, FIG. 1, it may bear a birthday greeting 15, holiday or other special event greeting. On its opposite side, FIG. 2, it may receive any desired written message 16, or may be autographed. The device will accept a permanent ink message or a message written in pencil, depending on the wishes of the user.

In addition to forming a novelty message medium, the device may bear advertising indicia, such as a manufacturer's logo or trademark on one side, and any desired data on the other side. It may serve as an inexpensive birthday gift for children, business gift, premium, or promotional item. Its uses are manifold.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A written message carrier and spinning toy combination device comprising a pair of equal diameter equal thickness thin flat discs formed of stiff sheet material of a type which will accept writing by a pen or pencil at least on one face of each disc, a thin comparatively small diameter spacer ring between said discs coaxially and being adhesively fixed to the opposing interior faces of the discs and uniting them in parallel coaxially spaced relationship with the discs spaced apart a small distance not substantially greater than the thickness of the sheet material from which the discs are formed, said spacer ring forming an axle for the device, and a tether attached to the spacer ring and adapted to be wound thereon substantially in convolutions which overlap one another in a common plane radially of the discs, the thickness of the tether being such that the wound tether convolutions substantially fill the narrow space between said discs in the region occupied by the convolutions.

2. A written message carrier and spinning toy combination device as defined in claim 1, and the discs being formed of plastics material and having a diameter of substantially $4\frac{1}{2}$ inches and the thickness of each disc not exceeding substantially 3/32 inch.

* * * * *